US012781374B2

(12) United States Patent
Manz

(10) Patent No.: US 12,781,374 B2
(45) Date of Patent: Nov. 3, 2026

(54) STABILIZATION OF THE DEPOSITION RATE OF PLATINUM ELECTROLYTES

(71) Applicant: Umicore Galvanotechnik GmbH, Schwaebisch Gmuend (DE)

(72) Inventor: Uwe Manz, Moegglingen (DE)

(73) Assignee: Umicore Galvanotechnik GmbH, Schwaebisch Gmuend (DE)

( * ) Notice: Subject to any disclaimer, the term of this patent is extended or adjusted under 35 U.S.C. 154(b) by 694 days.

(21) Appl. No.: 18/256,925

(22) PCT Filed: Dec. 17, 2021

(86) PCT No.: PCT/EP2021/086385

§ 371 (c)(1),
(2) Date: Jun. 11, 2023

(87) PCT Pub. No.: WO2022/129461

PCT Pub. Date: Jun. 23, 2022

(65) Prior Publication Data

US 2024/0060203 A1 Feb. 22, 2024

(30) Foreign Application Priority Data

Dec. 18, 2020 (DE) ..... 102020007789.7

(51) Int. Cl.
*C25D 3/50* (2006.01)
*C25D 3/56* (2006.01)
(Continued)

(52) U.S. Cl.
CPC ..... *C25D 3/50* (2013.01); *C25D 21/02* (2013.01); *C25D 21/14* (2013.01); *C25D 21/18* (2013.01); *C25D 3/567* (2013.01)

(58) Field of Classification Search
CPC ..... C25D 21/12; C25D 21/14; C25D 3/50; C25D 3/52
See application file for complete search history.

(56) References Cited

U.S. PATENT DOCUMENTS 2,984,604 A 5/1961 Duva et al.
4,673,472 A * 6/1987 Morrissey ..... C25D 3/52 205/265

(Continued)

FOREIGN PATENT DOCUMENTS

CN 108130566 6/2018
EP 0737760 10/1996

(Continued)

OTHER PUBLICATIONS

IC Application Note S392: Sulfamic acid besides hydramine and other anions in chemical solutions, Apr. 1, 2020, pp. 1-2, No. 1, Publisher: Metrohm USA.

(Continued)

*Primary Examiner* — Brian W Cohen
(74) *Attorney, Agent, or Firm* — Suzannah K. Sundby, Esq.; Canady + Lortz LLP

(57) ABSTRACT

The present invention is directed toward a method for stabilizing the electrolytic deposition of platinum from an electrolytic bath. In particular, the present invention relates to a corresponding method in which the platinum electrolytic bath has platinum in the form of a sulfamate complex.

8 Claims, 1 Drawing Sheet

Figure 1:
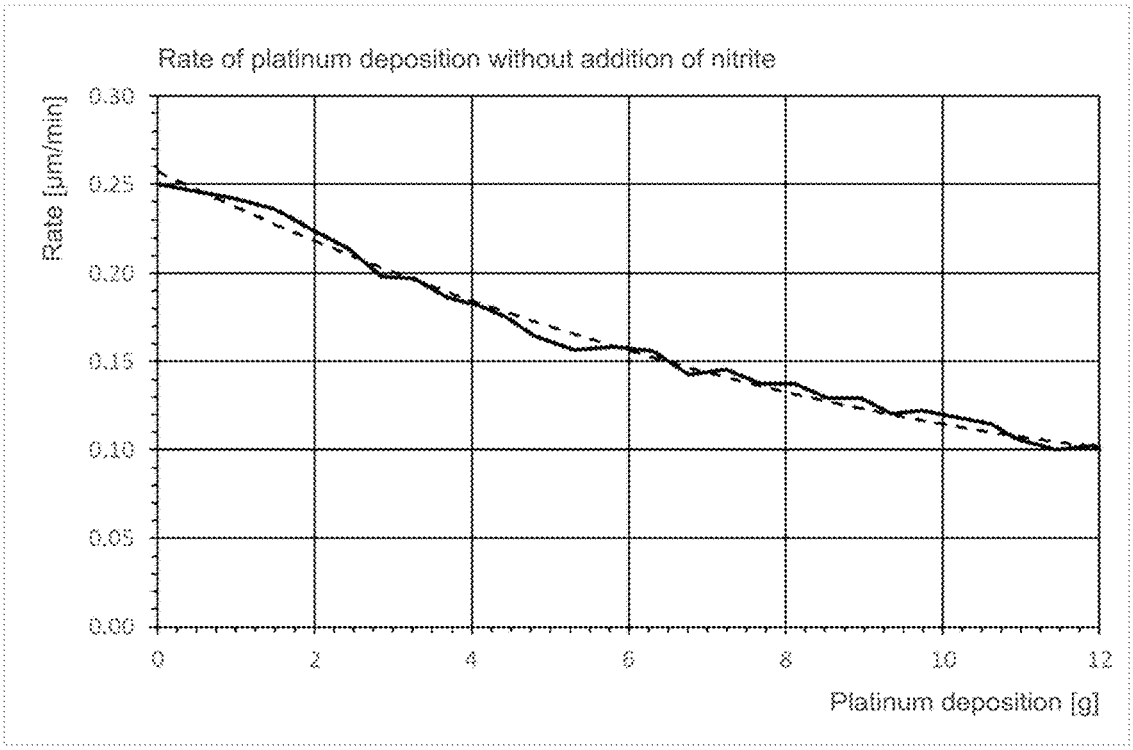

(51) Int. Cl.

| | |
|---|---|
| ***C25D 21/02*** | (2006.01) |
| ***C25D 21/14*** | (2006.01) |
| ***C25D 21/18*** | (2006.01) |

(56) References Cited

U.S. PATENT DOCUMENTS

| | | | | |
|---|---|---|---|---|
| 5,352,350 | A * | 10/1994 | Andricacos | C23C 18/1617 427/443.1 |
| 5,620,583 | A | 4/1997 | Kuhn | |
| 6,569,307 | B2 * | 5/2003 | Blachier | C25D 21/14 427/430.1 |
| 8,808,521 | B2 * | 8/2014 | Zhou | C25D 21/14 205/82 |

FOREIGN PATENT DOCUMENTS

| | | |
|---|---|---|
| JP | 36-019658 | 10/1961 |
| JP | H08319595 | 12/1996 |
| TW | 201137185 | 11/2011 |
| WO | 2013104877 | 7/2013 |

OTHER PUBLICATIONS

International Search Report received in PCT/EP2021/086385 mailed May 9, 2022.
Written Opinion received in PCT/EP2021/086385 mailed May 9, 2022.
Office Action received in TW11420525930 dated May 19, 2025 (machine translation).
Office Action received in JP2023531068 mailed Sep. 24, 2025.
Office Action received in CN 2021800844982 mailed May 25, 2026.
Office Action received in KR1020237023828 mailed Jun. 1, 2026.
Yu, et al., Properties, preparation, and applications of amidosulfonic acid, Jun. 30, 1997, pp. 46-47, vol. 20, No. 3, Publisher: J Daily Chem Prod Sci.

* cited by examiner

STABILIZATION OF THE DEPOSITION RATE OF PLATINUM ELECTROLYTES

The present invention is directed toward a method for stabilizing the electrolytic deposition of platinum from an electrolytic bath. In particular, the present invention relates to a corresponding method in which the platinum electrolytic bath has platinum in the form of a sulfamate complex.

The electroplating and electroforming of platinum is widely used in the production of ornaments and jewelry, not only because of the bright luster and aesthetic appeal of platinum, but also because of its high chemical and mechanical inertness. Platinum can therefore also serve as a coating for plug connections and contact materials.

Acidic and alkaline baths based on platinum(II) and platinum (IV) compounds are used for the electrodeposition of platinum. The most important bath types contain diamino-dinitrito-platinum (II) (P salt), sulfato-dinitrito-platinic acid (DNS), or hexahydroxoplatinic acid, or their alkali salts. The mentioned bath types are predominantly only suitable for the deposition of thin platinum layers of a few μm. The deposition of thick layers for technical applications is a general problem in the case of platinum. Either the layers have high internal stresses, become cracked and even split open, or the electrolytes are insufficiently stable and decompose relatively quickly given the long electrolysis durations.

In WO2013104877A1, a platinum electrolyte is proposed that should be stable over a longer duration and contains a source of platinum ions and a source of borate ions. The bath generally has good thermal stability. The bath can also be used over a wide range of pH values. In certain embodiments, the baths yield a bright and shiny deposit.

EP737760A1 describes a Pt electrolyte which contains at most 5 g/l of free amidosulfuric acid (ASS, sulfamidic acid, sulfamic acid, amidosulfonic acid) and 20 to 400 g/l of a strong acid with a pH value of less than 1. The platinum amine sulfamate complexes used here proved to be surprisingly stable in the strongly acidic bath without free amidosulfuric acid. The bath showed no precipitation formation even given long electrolysis durations.

Amidosulfonic acid released during the deposition of the platinum is hydrolyzed and therefore should not accumulate in the electrolyte. However, in less strongly acidic baths and at normal electrolysis temperatures, the hydrolysis is comparatively slow.

It has been found that electrolytes in which platinum sulfamate complexes are used initially exhibit an average current yield with acceptable deposition rate and deposition speed. However, these parameters continuously fall relatively quickly to uneconomic values over the course of deposition. Increasingly more hydrogen is then co-deposited, and the maximum layer thickness that can be deposited without cracking thereby also falls.

There has therefore been a need for further improved methods for the electrodeposition of a platinum layer. These and additional objects that are evident from the prior art to the person skilled in the art are achieved via a method having the features of the objective Claim 1. Preferred developments of the method according to the invention are addressed in Claims 2 to 8.

The posed object is achieved very easily, but no less advantageously, in that, in a method for stabilizing the deposition of platinum from an acidic, aqueous, cyanide-free electrolyte bath containing a platinum sulfamate complex, the amidosulfonic acid released from the platinum sulfamate complex during electrolysis is destroyed in the electrolysis bath. Obviously, the falling deposition rate of the platinum results due to the amidosulfonic acid released from the platinum sulfamate complex upon deposition. In that the released amidosulfonic acid is now destroyed, the useful life of the electrolyte can be radically extended. Operating costs and time savings are thereby realized, which contributes significantly to the benefits of platinum deposition.

In an advantageous embodiment, a quantity of a soluble nitrite salt corresponding to the amidosulfonic acid is added to the bath in order to destroy said amidosulfonic acid. Sodium nitrite or potassium nitrite are preferably used. Under the given bath conditions, the reaction (1) then proceeds upon electrolysis:

$$Pt(NH_3)_2(NH_2SO_3)_2+H_2SO_4 \rightarrow Pt(s)+NH_4HSO_4+NH_2SO_3H \quad (1)$$

The following reaction (2) is triggered by the addition of nitrite salts:

$$NH_2SO_3H+NaNO_2 \rightarrow N_2+H_2O+NaHSO_4 \quad (2)$$

This method works for any platinum sulfamate complex. These may be selected from the group consisting of $H_2[Pt(NH_2SO_3)_2SO_4]$, $H_2[Pt(NH_2SO_3)_2SO_3]$, $H_2[Pt(NH_2SO_3)_2Cl_2]$, $[Pt(NH_3)_2(NH_2SO_3)_4]$, and $[Pt(NH_3)_2(NH_2SO_3)_2]$. $H_2[Pt(NH_2SO_3)_4]$ and $[Pt(NH_3)_2(NH_2SO_3)_2]$ can also be particularly advantageously used. The common compounds known to the person skilled in the art and readily soluble in water are considered as nitrite salts. In particular, these are hereby sodium nitrite and potassium nitrite.

In order to avoid an excess of nitrite salt in the electrolyte and to destroy as much of the released amidosulfonic acid as possible, these should be determined in advance. This can be done by calculation, for example. The stoichiometrically necessary nitrite quantity may be calculated from the concentration of amidosulfonic acid (ASS) that is free or released during operation of the electrolyte. Here is an example: If platinum is deposited from a Pt complex having two moles of sulfamate per 1 mole of platinum, a quantity of 2×100 g/195.1 g/mol=1.2 moles of ASS will be released per 100 g of Pt. Accordingly, the released amidosulfonic acid is destroyed by an addition of 1.2 moles of sodium nitrite=46.9 g $NaNO_2$. Since the amidosulfonic acid, depending on the anodes used, may also be partially destroyed by anodic oxidation or decomposed by hydrolysis, it is advisable to determine the necessary nitrite quantities in a practical experiment. The free amidosulfonic acid in the bath is therefore preferably determined during electrolysis. This can advantageously be done via ion chromatography or capillary electrophoresis, for example. The person skilled in the art knows how to proceed here (see, for example: www.metrohm.com/de-de/applikationen/AN-S-392). One possibility for quantifying ASS is provided in that samples are taken from the electrolyte that is used, and the ASS herein is destroyed by nitrite salts. The resulting nitrogen can then be determined via the increase in pressure, for example.

In principle, two method variants for destroying the released amidosulfonic acid are thus available to the person skilled in the art. When the deposition rate (for its determination, see the Example section) of the electrolyte is decreasing excessively, electrolysis can be interrupted, the amidosulfonic acid destroyed according to the invention with nitrite salts, and the electrolysis process then resumed. Alternatively and preferably, however, there is the variant in which destruction of the ASS takes place during the electrolysis.

For this purpose, necessary quantities of the nitrite salt are added to the electrolysis bath while the electrolysis is in progress. The electrolysis preferably proceeds at a temperature of 20° C. to 90° C., more preferably at 30° C. to 80° C., and very preferably at 40° C. to 70° C. In these temperature ranges, the amidosulfonic acid is decomposed sufficiently quickly by the added nitrite salt, wherein high temperatures are possibly to be preferred since they increase the reaction rate. The person skilled in the art can determine the optimal decomposition temperature themselves.

In a further embodiment of the present invention, the amidosulfonic acid can be hydrolyzed from time to time by heating. Electrolysis is hereby stopped insofar as the deposition speed falls below a certain value (determination according to the Example section). Hydrolysis in acid medium (3) to ammonium hydrogen sulfate proceeds as follows:

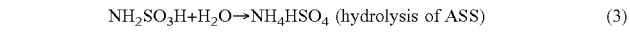

$$NH_2SO_3H+H_2O \rightarrow NH_4HSO_4 \text{ (hydrolysis of ASS)} \quad (3)$$

For this purpose, the electrolyte in a temperature-resistant vessel (e.g., glass reactor, enamel reactor, glass trough etc.) is subjected to a hydrolysis treatment for several hours (2 h-5 h) at the highest possible temperatures. It is advantageous if the hydrolysis takes place at up to the boiling temperature of the electrolyte. A permissible maximum temperature of the electrolyte that is used should thereby optionally be observed in order to avoid disadvantages in deposition (e.g. loss of luster). The hydrolysis therefore preferably takes place at a maximum of 98° C., more preferably at a maximum of 95° C. Alternatively, during the electrolytic deposition, a partial quantity or a partial stream of the electrolyte may be removed in the bypass, heated, hydrolyzed/treated and, once cooled to the operating temperature, be added back to the electrolyte.

The actual electrolysis process, the hydrolysis just discussed, as well as the decomposition of the amidosulfonic acid with nitrite salts take place within the acidic pH range. The electrolyte bath preferably has a pH value <7, more preferably <4, and very preferably between <2 and 0. Compliance with these pH values is the responsibility of the person skilled in the art.

The method according to the invention can be used for platinum sulfamate electrolysis baths known to the person skilled in the art, such as the one from EP737760A1. A particular advantage of the method discussed here is that, in the event of the electrolysis being interrupted, the electrolyte bath can be reused after the amidosulfonic acid has been destroyed. If necessary, certain consumed components are simply replenished. The continuous destruction of the ASS with nitrite salt also leads to the situation that the useful life of the electrolyte can be maximally extended with the method according to the invention, and the platinum sulfamate complex that is used can be optimally utilized. This leads to savings in working time and material costs. As of the priority date, this was not to be expected by the person skilled in the art.

The term "electrolyte bath" is understood according to the invention to mean the aqueous electrolyte which is placed into a corresponding vessel and used with an anode and a cathode under current flow for electrolysis.

FIGURES

Figure 2:
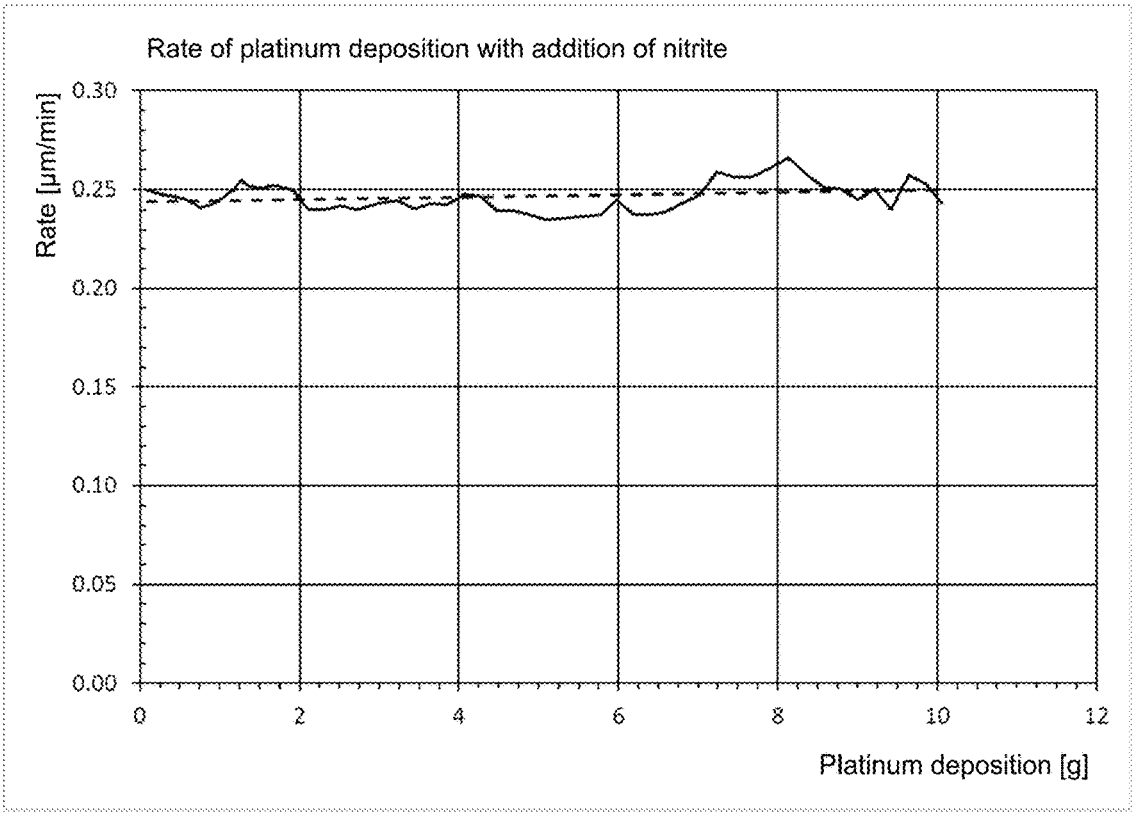

FIG. 1: Deposition rate of Pt from a Pt sulfamate electrolyte, without the addition of nitrite FIG. 2: Deposition rate of Pt from a Pt sulfamate electrolyte, with the addition of nitrite

EXAMPLE

The deposition rate can be determined as follows:

1 liter of an electrolyte (as in EP737760A1) is heated to the temperature mentioned in the exemplary embodiment by means of a magnetic stirrer, while being stirred with a cylindrical magnetic stirring rod 60 mm long at at least 200 rpm. This stirring and temperature is also maintained during the coating.

Platinum-plated titanium or titanium coated with mixed metal oxide is used as an anode material. A respective anode is attached parallel to the cathode on both sides of the cathode. A mechanically polished brass plate with a surface area of at least 0.2 $dm^2$ serves as cathode. This can be coated beforehand with at least 2 μm of nickel from an electrolyte which produces high-gloss layers. A gold layer approximately 0.1 μm thick may also be deposited on the nickel layer.

Prior to introduction into the electrolyte, these cathodes are cleaned with the aid of electrolytic degreasing (5-7 V) and an acid dip containing sulfuric acid (c=5% sulfuric acid). Between each cleaning step and before introduction into the electrolyte, the cathode is rinsed with deionized water.

The cathode is positioned in the electrolyte between the anodes and moved parallel thereto by at least 3 m/min. The distance between anode and cathode should not thereby change.

In the electrolyte, the cathode is coated by applying a direct electric current between anode and cathode. The amperage is thereby selected such that the current density predetermined for the test is achieved over the surface area, e.g. 20 $mA/cm^2$. The duration of the current flow is selected such that the layer thickness predetermined for the test (e.g. 1 μm) is achieved on average over the surface area. After coating, the cathode is removed from the electrolyte and rinsed with deionized water. The drying of the cathodes can take place via compressed air, hot air, or centrifugation.

The surface area of the cathode, the level and duration of the applied current, and the weight of the cathode before and after coating are documented and used for determining the average layer thickness as well as the efficiency or rate of deposition.

Results:

At an operating temperature of 55° C., platinum can initially be deposited with 0.25 μm/min at 2 $A/dm^2$ in a freshly prepared platinum electrolyte (as in EP737760A1) with 10 g/l of Pt as a Pt sulfamate complex and 20 g/l of sulfuric acid. After a deposition of 10 g/l of Pt, only a deposition rate of about 0.12 μm/min is now achieved. This corresponds to a reduction to 45% of the original rate.

Given a corresponding deposition with 10 g/l of Pt at 60° C., in the initial state layers 2 μm thick are deposited as shiny and homogeneous layers. Without added nitrite, an increasing deterioration in appearance occurs over the course of throughput. After a deposition of 10 g/l of Pt, the deposited coatings are milky, brown, and blotchy. If electrolytic platinum deposition takes place with the addition of nitrite such that the deposition rate is kept approximately stable, the layers will be practically invariantly glossy and homogeneous.

The porosity of the deposited layers likewise deteriorates during electrolytic platinum deposition without the addition of nitrite. This is manifested by significantly poorer corrosion results, detectable given platinum layers 1 μm thick under anodic stress in a 1% sodium chloride solution at 40° C. and 5 V voltage and a Pt counter-electrode. In the initial state, given a platinum layer thickness of 1 μm on 2 μm of glossy nickel-plated copper substrate, it can be observed via optical microscope under 20× magnification that more than 120 minutes will pass without the layers being torn open by corrosion products. After a throughput of 10 g/l of platinum without the addition of nitrite, this value falls to below 5-10 minutes, caused by the increased porosity of the deposited platinum layer. If, given the same throughput, the deposition rate is kept constant via regular addition of nitrite, the deterioration of the corrosion resistance then is not observed.

The invention claimed is:

1. A method for stabilizing the deposition of platinum from an electrolytic bath, which is an acidic, aqueous, cyanide-free electrolytic bath containing a platinum sulfamate complex, which comprises detecting amidosulfonic acid present in the electrolytic bath that is released from the platinum sulfamate complex during electrolysis; and destroying the amidosulfonic acid by adding a soluble nitrite salt in an amount that corresponds to the amount of the amidosulfonic acid detected.

2. The method according to claim 1, wherein the amidosulfonic acid is destroyed while performing electrolysis using the electrolytic bath.

3. The method according to claim 1, wherein the pH value of the electrolytic bath is <7.

4. The method according to claim 1, which further comprises replenishing the amount of the platinum sulfamate complex in the electrolytic bath.

5. A method for electrolytic deposition of platinum, which comprises performing electrolysis using an electrolytic bath, which is an acidic, aqueous, cyanide-free electrolytic bath containing a platinum sulfamate complex;

interrupting the electrolysis;

after interrupting the electrolysis, destroying amidosulfonic acid present in the electrolytic bath that was released from the platinum sulfamate complex during the electrolysis by adding a soluble nitrite salt to the electrolytic bath; and restarting the electrolysis.

6. The method according to claim 5, wherein the soluble nitrate salt is added in a quantity corresponding to the amount of amidosulfonic acid present in the electrolytic bath.

7. The method according to claim 5, wherein the pH value of the electrolytic bath is <7.

8. The method according to claim 5, which further comprises replenishing the amount of the platinum sulfamate complex in the electrolytic bath.

* * * * *